US008004375B2

(12) United States Patent
Hwang et al.

(10) Patent No.: US 8,004,375 B2
(45) Date of Patent: Aug. 23, 2011

(54) RESONATOR AND BANDPASS FILTER HAVING OVERLAY ELECTROMAGNETIC BANDGAP (EBG) STRUCTURE, AND METHOD OF MANUFACTURING THE RESONATOR

(75) Inventors: Cheol-gyu Hwang, Daejeon-si (KR); Sung-tae Choi, Hwaseong-si (KR); Jung-han Choi, Hwaseong-si (KR); Seung-ho Hwang, Seoul (KR); Young-hwan Kim, Hwaseong-si (KR); Dong-hyun Lee, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 442 days.

(21) Appl. No.: 12/135,363

(22) Filed: Jun. 9, 2008

(65) Prior Publication Data

US 2009/0212885 A1 Aug. 27, 2009

(30) Foreign Application Priority Data

Feb. 22, 2008 (KR) ..... 10-2008-0016495

(51) Int. Cl.
*H01P 1/203* (2006.01)
*H01P 7/08* (2006.01)

(52) U.S. Cl. ..... 333/205; 333/204; 333/219; 333/235

(58) Field of Classification Search ..... 333/168, 333/175, 174, 185, 202–205, 235
See application file for complete search history.

(56) References Cited

U.S. PATENT DOCUMENTS

| | | | | |
|---|---|---|---|---|
| 6,847,273 | B2 | 1/2005 | Shin-Hsuan et al. | |
| 7,046,103 | B2 | 5/2006 | Whatmore et al. | |
| 7,248,131 | B2 | 7/2007 | Fazzio et al. | |
| 2004/0169264 | A1 | 9/2004 | Lee et al. | |
| 2007/0097005 | A1 * | 5/2007 | Boisbouvier et al. | 343/767 |
| 2008/0238578 | A1 * | 10/2008 | Satoh et al. | 333/204 |
| 2008/0272859 | A1 * | 11/2008 | Sangawa et al. | 333/205 |

FOREIGN PATENT DOCUMENTS

| | | |
|---|---|---|
| JP | 2005-318366 | 11/2005 |
| KR | 2002-78789 | 10/2002 |
| KR | 2003-90142 | 11/2003 |

OTHER PUBLICATIONS

Lee et al, "The super high frequency and the millimeter wave band package having the low pass filtering roofing tile low pass filters using the new PBG structure built-in", Sep. 3, 2003, English language translation of Korean application No. 1020030011969.*

* cited by examiner

*Primary Examiner* — Benny Lee
*Assistant Examiner* — Gerald Stevens
(74) *Attorney, Agent, or Firm* — Staas & Halsey LLP

(57) ABSTRACT

Provided is an Electromagnetic Bandgap (EBG) structure, particularly, a resonator and a bandpass filter having an overlay EBG structure, and a method of manufacturing the resonator. The resonator is manufactured by forming a transmission line and ground plates on a substrate, arranging a plurality of reflector units at regular intervals along the longitudinal direction of the transmission line, and removing at least one reflector among the plurality of reflectors, thus forming a common resonating mode. Therefore, since reflector units constructing capacitance components are separated from a substrate, it is possible to prevent electromagnetic waves from leaking out of the substrate and ensure a high Q characteristic in a high frequency environment due to a resonating unit formed between the reflector units.

12 Claims, 7 Drawing Sheets

RESONATOR AND BANDPASS FILTER HAVING OVERLAY ELECTROMAGNETIC BANDGAP (EBG) STRUCTURE, AND METHOD OF MANUFACTURING THE RESONATOR

CROSS-REFERENCE TO RELATED APPLICATIONS

This application claims priority from Korean Patent Application No. 10-2008-0016495, filed on Feb. 22, 2008, the disclosure of which is incorporated herein in its entirety by reference.

BACKGROUND OF THE INVENTION

1. Field of the Invention

The present invention relates to an Electromagnetic Bandgap (EBG) structure, and more particularly, to a resonator and a bandpass filter having an overlay Electromagnetic Bandgap (EBG) structure, and a method of manufacturing the resonator.

2. Description of the Related Art

Recently, many communication equipments are becoming lighter and smaller according to customer demands requiring portability. In order to manufacture communication equipments smaller, high frequency bandwidths have to be used. When high frequency bandwidths are used, the size reduction of communication equipments is possible and also a large amount of communication channels is available.

A communication equipment essentially requires a function of selecting or controlling a specific frequency. In order to implement the function, generally, a communication equipment includes a circuit structure of selecting or controlling a specific frequency. The circuit structure may be a resonator, a filter, etc.

The circuit structure, such as a resonator or filter, for selecting and controlling a frequency may be implemented by arranging lumped type passive elements (for example, inductors, capacitors).

However, when a resonator or a filter is manufactured having general passive elements, the resonator or filter may perform undesired operation at a high frequency. That is, if a wavelength is shortened at a high frequency, interrupt between communication lines becomes significant. In the case of a general passive element, since such interrupt between communication lines increases unexpected factors, the general passive element may not properly operate at a high frequency bandwidth (or at a millimeter wave bandwidth).

A representative study on development of a passive element capable of operating at a high frequency bandwidth is to integrate existing lumped elements on a plane and estimate parasitic components in a high frequency environment.

Another study on development of a passive element capable of operating at a high frequency bandwidth is to use an electromagnetic band gap (EBG) structure in which a photonic band gap (PBG) structure for guiding photons is applied in a high frequency area. Such an EBG structure is applied to resonators, filters, etc. of various small-sized communication devices, because the EBG structure is suitable to package a high frequency circuit.

SUMMARY OF THE INVENTION

The present invention provides an Electromagnetic Bandgap (EBG) structure, particularly, a resonator and bandpass filter, which can reduce leakage loss of electromagnetic waves, caused by a substrate, and ensure a high Q factor, and a method of manufacturing the resonator.

According to an aspect of the present invention, there is provided a resonator having an overlay Electromagnetic Bandgap (EBG) structure, including: a transmission line through which a signal flows; a plurality of ground plates formed in both sides of the transmission line; a plurality of reflectors whose portions face the plurality of ground plates, and formed at regular intervals along a longitudinal direction of the transmission line; and a resonating part resonating the signal flowing through the transmission line, and formed by adjusting any one interval among intervals between the plurality of reflectors.

According to another aspect of the present invention, there is provided a resonator having an overlay electromagnetic bandgap (EBG) structure, including: a transmission line through which a signal flows; a plurality of ground plates formed in both sides of the transmission line; and a plurality of reflectors, each including a plate which is separated from the transmission line and whose portions face the plurality of ground plates, and an interconnecting via for connecting the plate to the transmission line, wherein the plurality of reflectors are arranged at regular intervals along a longitudinal direction of the transmission line, and at least one reflector among the plurality of reflectors arranged at regular intervals is removed.

According to another aspect of the present invention, there is provided a bandpass filter formed by arranging a plurality of resonators having the overlay EBG structure along the longitudinal direction of transmission lines.

According to an aspect of the present invention, a method of manufacturing a resonator having an overlay electromagnetic bandgap (EBG) structure, including depositing a first metal layer on a substrate and etching the first metal layer to form a transmission line and a plurality of ground plates on both sides of the transmission line is provided. The method includes applying an insulating film on the transmission line and the ground plates, and depositing a second metal layer on the insulating film and etching the second metal layer to form a plurality of reflectors at regular intervals along the longitudinal direction of the transmission line, wherein at least one interval among the regular intervals between the plurality of reflectors is formed wider than the remaining intervals between the plurality of reflectors.

An interval wider than the regular intervals between the reflectors is formed by masking a part of the insulating film before depositing the second metal layer, or by removing a reflector when the second metal layer is etched.

Additional aspects of the invention will be set forth in the description which follows, and in part will be apparent from the description, or may be learned by practice of the invention.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the aspects of the invention.

DETAILED DESCRIPTION OF THE EXEMPLARY EMBODIMENTS

Figure 1:
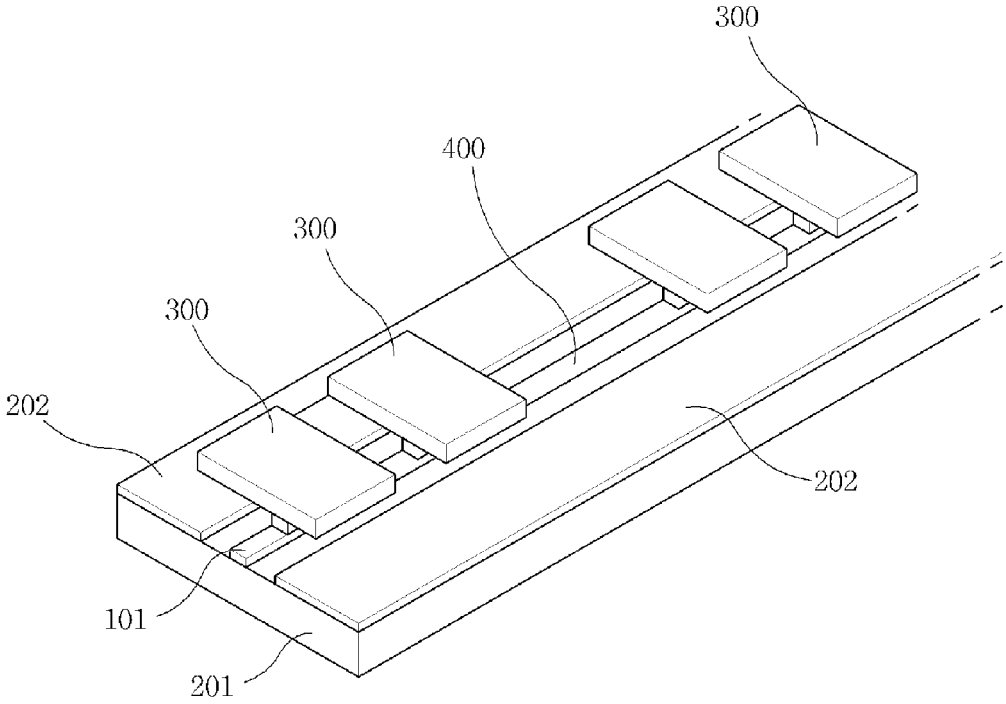
FIG. 1 is a perspective view of a resonator having an overlay Electromagnetic Bandgap (EBG) structure, according to an embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

Figure 2:
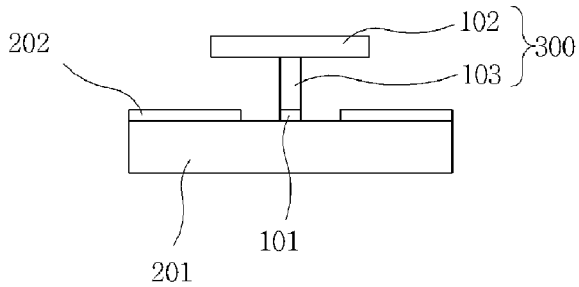
FIG. 2 is a front view of the resonator illustrated in FIG. 1.
Figure 3:
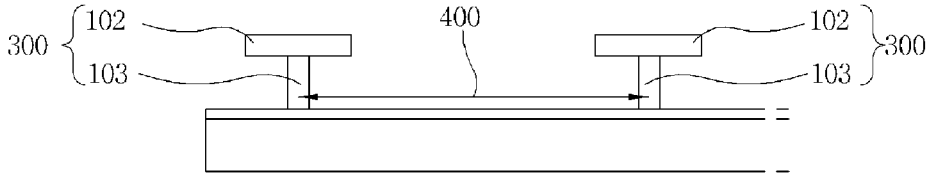
FIG. 3 is a side view of the resonator illustrated in FIG. 1.
Figure 4:
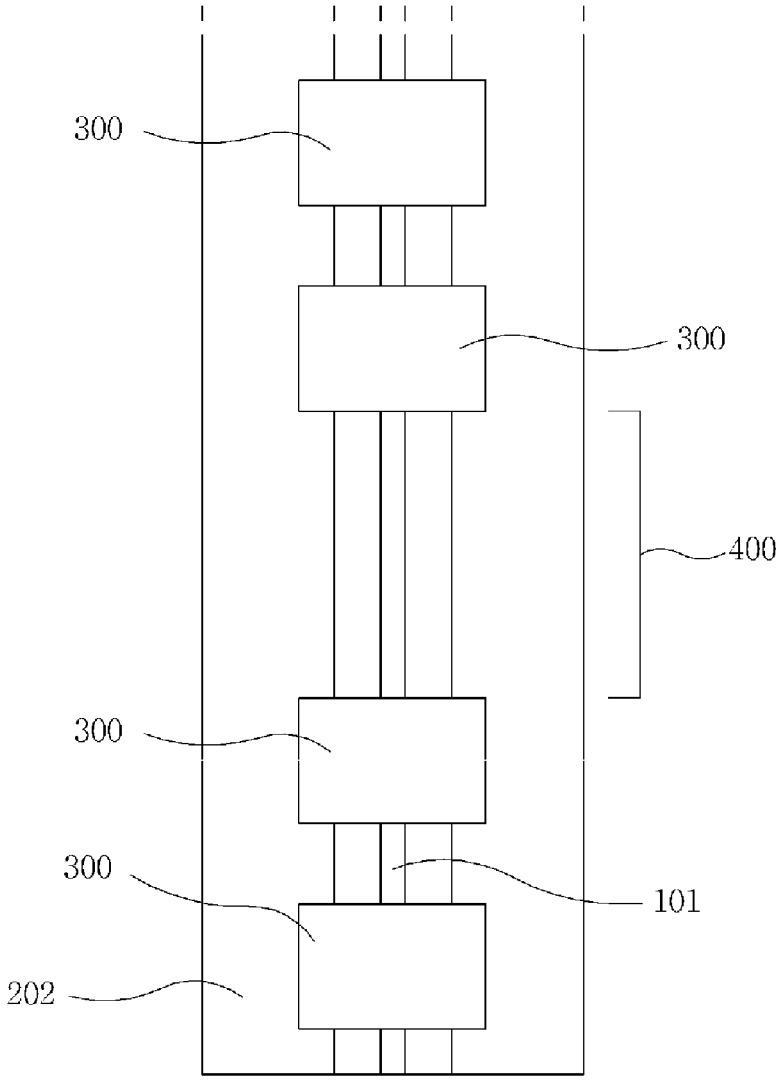
FIG. 4 is a plan view of the resonator illustrated in FIG. 1.

FIGS. 1 through 4 are views showing a resonator having an overlay Electromagnetic Bandgap (EBG) structure, according to an embodiment of the present invention, wherein FIG. 1 is a perspective view of a resonator having an overlay EBG structure according to an embodiment of the present invention, FIG. 2 is a front view of the resonator, FIG. 3 is a side view of the resonator, and FIG. 4 is a plan view of the resonator.

Referring to FIGS. 1 through 4, the resonator includes a transmission line 101, two ground plates 202, a plurality of reflectors 300, and a resonating part 400.

The transmission line 101, which is a metal line through which signals can flow, is formed on a substrate 201 and transmits signals on the substrate 201.

Here, the signals flowing through the transmission line 101 may be electromagnetic waves having a high frequency (for example, a millimeter-wave band of 60-80 GHz). The transmission line 101 may be a central signal line of a coplanar waveguide (CPW).

The ground plates 202, which are metal plates formed on the substrate 201, are formed with the transmission line 101 in between.

The ground plates 202 may be made of the same material as that of the transmission line 101. In the current embodiment, the ground plates 202 are used as grounds of the resonator having the overlay EBG structure.

The plurality of reflectors 300 are formed at regular intervals along the longitudinal direction of the transmission line 101, and some portions of the reflectors face the ground plates 202, thus forming capacitance components.

Here, the reflectors 300 are formed on the transmission line 101. Each reflector 300 may consist of a plate 102 whose portions face the ground plates 202, and an interconnecting via 101 through which the plate 102 is connected to the transmission line 101 (see FIG. 2). Also, the reflectors 300 may be made of the same material as that of the transmission line 101 and the ground plates 202.

Accordingly, as illustrated in FIG. 2, if the reflectors 300 having a "T" shape are connected to the transmission line 101 and face the ground plates 202, the reflectors 300 function as bypass capacitors connected to a path through which signals flow. Also, since the plurality of reflectors 300 are formed along the longitudinal direction of the transmission line 101, signals having a specific frequency among signals flowing through the transmission line 101 may be blocked by the reflectors 300. Here, by appropriately changing the dimension (for example, the size of a plate, the thickness of an interconnecting via, etc.) of each reflector 300, it is possible to change frequency characteristics, and block signals having a specific frequency band among signals flowing through the transmission line 101 by changing the frequency characteristics.

The resonating part 400 is formed by adjusting any one interval among the intervals between the reflectors 300, and functions to resonate signals flowing through the transmission line 101.

For example, the resonating unit 400 is formed by removing any one reflector among the reflectors 300 arranged at regular intervals. That is, if any one reflector among the reflectors 300 arranged at regular intervals along the longitudinal direction of the transmission line 101 is removed, an interval wider than the regular interval is made in a space from which the reflector is removed, and the wide interval becomes the resonating part 400. However, forming the resonating part 400 by removing a reflector is exemplary, and the resonating part 400 can be formed using any other method. Accordingly, it can be understood that the resonating part 400 is an interval between the reflectors 300, which is formed wider or narrower than a regular interval between the reflectors 300 by adjusting any one interval among the intervals between the reflectors 300. The intervals between the reflectors 300 can be defined as distances between the interconnecting vias 103, as illustrated in FIG. 3.

The resonance characteristics of the resonator according to the current embodiment can be determined by the resonating part 400. For example, if the resonating part 400 is formed as an interval wider than the regular interval between the reflectors 300, a cavity resonance effect can be provided to the resonator structure.

Also, the plurality of reflectors 300 are arranged with the resonating part 300 in between. That is, since the reflectors 300 for blocking signals having a specific frequency band are located with the resonating part 400 in between, signals flowing through the transmission line 101 are bounced at both ends of the resonating part 400, and accordingly, the resonating part 400 oscillates the signals flowing through the transmission line 101, thereby providing a resonance mode.

The length of the resonating part 400 can be appropriately adjusted according to a resonant frequency of the resonator. For example, by increasing the length of the resonating part 400, frequency tuning is possible to lower a resonant frequency.

Accordingly, in the current embodiment of the present invention, since the plates 102 of the reflectors 300 are separated from the substrate 201, it is possible to prevent electromagnetic waves from leaking out of the substrate 201. Also, since the reflectors 300 are arranged at regular intervals and the resonating part 400 is formed by adjusting the intervals between the reflectors 300, a high Q factor can be ensured. Particularly, since the higher the frequency of a signal, the more leakage loss through the substrate 201, the resonator according to the current embodiment can prevent a Q factor from deteriorating due to such leakage loss.

Figure 5:
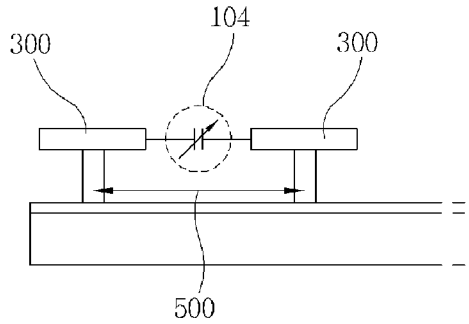
FIG. 5 is a side view of a resonator having an overlay EBG structure, according to another embodiment of the present invention.

FIG. 5 is a side view of a resonator having an overlay EBG structure, according to another embodiment of the present invention. The resonator illustrated in FIG. 5 is implemented by inserting a varactor 104 in the resonating part 500 of the resonator illustrated in FIGS. 1 through 4.

In FIG. 5, the resonating part 500 is formed by adjusting an interval between reflectors 300, as described above. For example, as illustrated in FIG. 5, a reflector among a plurality of reflectors 300 is removed and the resonating part 500 is formed in a space from which the reflector is removed.

The varactor 104 formed in the resonating part 500 may be a variable capacitance diode whose electrostatic capacity changes according to a voltage. The varator 104 can be inserted in the resonating part 500 in such a manner as to connect both ends of the varactor 104 to the plates 102 of the reflectors 300.

Accordingly, by adjusting a voltage which is applied to the varactor 104, an electrostatic capacity of the varactor 104 is changed, and accordingly, the capacitances of the reflectors 300 are changed, so that the frequency characteristics of the resonator having the overlay EBG structure, according to the current embodiment of the present invention, can be tuned.

Figure 6:
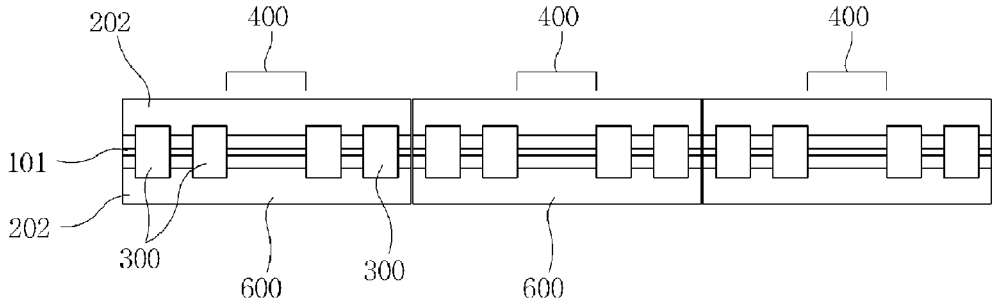
FIG. 6 is a plan view of a bandpass filter having an overlay EBG structure, according to an embodiment of the present invention.

FIG. 6 is a plan view of a bandpass filter having an overlay EBG structure, according to an embodiment of the present invention.

Referring to FIG. 6, the bandpass filter is formed by connecting a plurality of resonator units 600 in series. In FIG. 6, each resonator unit 600 includes a transmission line 101, two ground plates 202, a plurality of reflectors 300, and a resonating part 400. Also, each resonator unit 600 can further include a varactor 104. Here, the components may be components described above with reference to FIGS. 1 and 2, and therefore detailed descriptions therefor will be omitted.

A resonant frequency characteristic of each resonator unit depends on the reflectors 300 for blocking signals having a specific frequency band and a resonating part 400 for resonating signals between the reflectors 300. Since the plates of the reflectors 300 are separated from a substrate 201 and thus leakage of electromagnetic waves through the substrate 201 is prevented, each resonator unit 600 has a high Q factor. Accordingly, by connecting a plurality of resonator units 600 in series along the longitudinal direction of the transmission line 101, it is possible to prevent signals having a specific frequency band from flowing through the resonator units 600 and obtain an excellent frequency selection characteristic.

FIG. 6 shows an example in which a bandpass filter is configured by connecting a plurality of resonator units 600 in series. However, the present invention is not limited to this, and by connecting the plurality of resonator units 600 in series, an oscillator having a low phase-to-noise characteristic can also be constructed.

Now, a method of manufacturing a resonator having an overlay EBG structure, according to an embodiment of the present invention, will be described with reference to FIGS. 7 and 8A through 8D.

Figure 7:
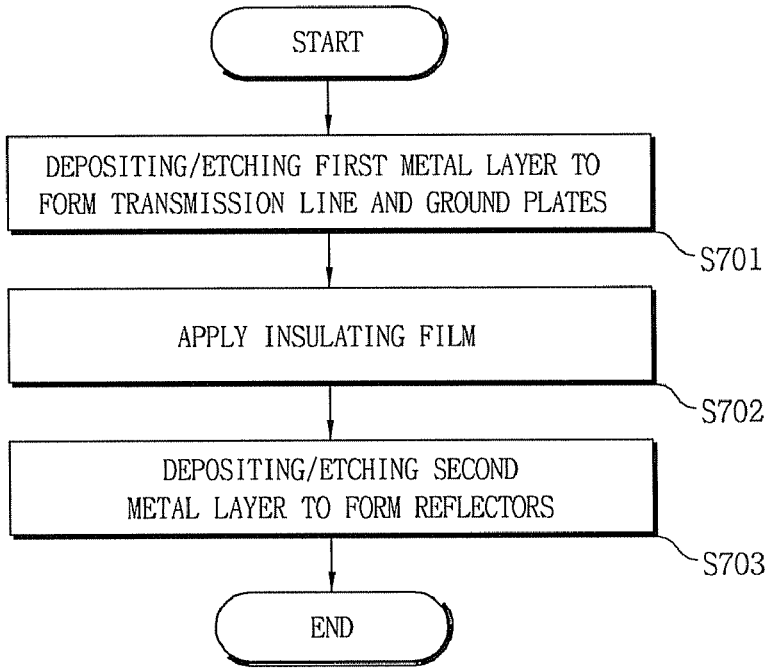
FIG. 7 is a flowchart of a method of manufacturing a resonator having an overlay EBG structure, according to an embodiment of the present invention.

FIG. 7 is a flowchart of a method of manufacturing a resonator having an overlay EBG structure, according to an embodiment of the present invention. As illustrated in FIG. 7, the resonator manufacturing method includes: applying and etching a first metal layer 401 to form a transmission line 101 and two ground plates 202 (operation S701); applying an insulating film 403 on the transmission line 101 and the ground plates 202 (operation S702); applying a second metal layer 402 on the insulating film 403 and etching the second metal layer 402 to form a reflector 300 (operation S703).

Figure 8A:
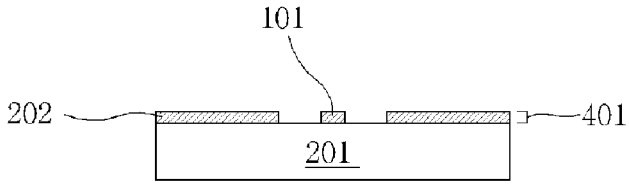
FIGS. 8A through 8D are views for explaining the resonator manufacturing method illustrated in FIG. 7.

First, as illustrated in FIG. 8A, the first metal layer 401 is applied on a substrate 201 and then etched, thus forming the transmission line 101 and ground plates 202 (operation S701). Here, the transmission line 101 is formed on the center region of the substrate 201, and the ground plates 202 are formed in both sides of the transmission line 101.

Figure 8B:
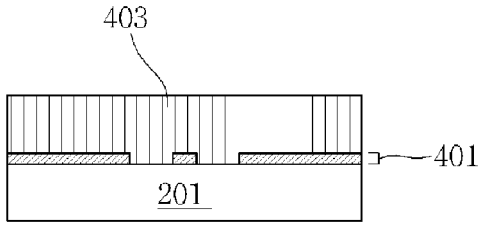
Figure 8C:
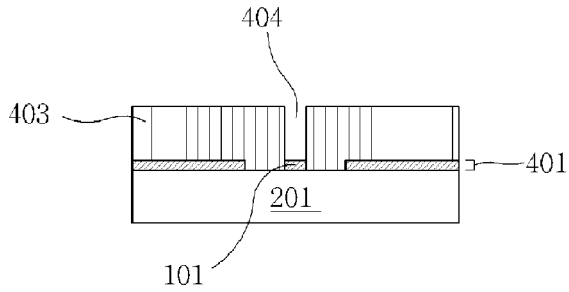
Figure 8D:
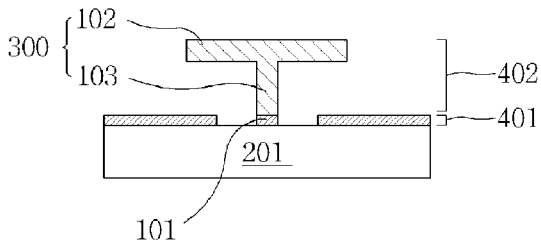

Then, as illustrated in FIG. 8B, the insulating film 403 is applied on the first metal layer 401 (operation S702). The insulating film 403 may be a dielectric film, such as an oxide film or a nitride film, and disposed between the first metal layer 401 and the second metal layer 402 which will be described later. Thereafter, the second metal layer 402 is applied on the insulating film 403 and then etched, thus forming the reflector 300 as illustrated in FIG. 8D. Before forming the reflector 300, a via hole 404 for connecting the first metal layer 401 to the second metal layer 402 can be formed (see FIG. 8C). That is, the reflector 300 formed by the second metal layer 402 can consist of a plate 102 facing the ground plates 202 and an interconnecting via 103 for connecting the plate 102 to the transmission line 101. The via hole 404 provides a space in which the interconnecting via 103 will be formed.

Thereafter, the second metal layer 402 is applied on the insulating film 403 on which the via hole 404 is formed, and the second metal layer 402 is etched, so that the reflector 300 illustrated in FIG. 8D is formed (operation S703). In operation S703, a plurality of reflectors 300 are arranged at regular intervals along the longitudinal direction of the transmission line 101, and any one interval among intervals between the reflectors 300 is formed to be wider than other intervals. That is, in operation S703, by forming the plurality of reflectors 300 having the second metal layer 402, the resonator (400 in FIG. 1) described above is manufactured.

The reflectors 300 can be formed by depositing a sacrificial layer on the second metal layer 402 deposited on the insulating film 403, applying an appropriate photo mask on the sacrificial layer, and exposing and developing the photo mask. Here, by masking a part of the insulating film 403 before depositing the second metal layer 402 to form the resonating part 400 described above, it is possible to prevent the second metal layer 402 from being deposited on a space in which the resonating part 400 will be formed. Or, the resonating part 400 can be formed by appropriately adjusting the pattern of the photo mask to etch or remove one or more reflectors 300 when the second metal layer 402 is etched.

In the current embodiment of the present invention, a method of depositing or etching a first layer and a second layer using a CMOS semiconductor manufacturing method has been described. However, a method of forming first and second layers is not limited to the current embodiment. Accordingly, it is possible to form the signal line 101 and the ground plates 202 on the first metal layer 401 and form the reflectors 300 on the second metal layer 402 using various multi-layer manufacturing methods. When the reflectors 300 are formed using the second metal layer 402, the resonating part 400 is formed by adjusting the intervals between the reflectors 300.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A resonator having an overlay Electromagnetic Bandgap (EBG) structure, comprising:

a transmission line through which a signal flows;

a plurality of ground plates formed on both sides of the transmission line;

a plurality of reflectors whose portions face the plurality of ground plates, and formed at regular intervals along a longitudinal direction of the transmission line; and a resonating part resonating the signal flowing through the transmission line, and formed by adjusting any one interval among the regular intervals between the plurality of reflectors.

2. The resonator of claim 1, wherein each reflector among the plurality of reflectors comprises:

a plate separated from the transmission line, portions of the plate facing the ground plates; and an interconnecting via connecting the plate to the transmission line.

3. The resonator of claim 2, wherein the regular intervals between the plurality of reflectors are defined as distances between interconnecting vias.

4. The resonator of claim 1, wherein the one interval among the regular intervals is adjusted to be wider than the remaining intervals between the plurality of reflectors.

5. The resonator of claim 1, wherein the one interval among the plurality of regular intervals is formed by removing at least one reflector among the plurality of reflectors to adjust the regular intervals between the plurality of reflectors.

6. The resonator of claim 1, wherein the resonating part provides a resonance mode by oscillating the signal between two end reflectors of the plurality of reflectors located at both ends of the resonating part.

7. The resonator of claim 1, further comprising a varactor which is inserted in the resonating part and tunes a resonant frequency.

8. The resonator of claim 1, wherein a resonant frequency is tuned by adjusting a length of the resonating part.

9. A resonator having an overlay electromagnetic bandgap (EBG) structure, comprising:

a transmission line through which a signal flows;

a plurality of ground plates formed on both sides of the transmission line; and a plurality of reflectors, each including a plate which is separated from the transmission line and whose portions face the plurality of ground plates, and an interconnecting via for connecting the plate to the transmission line, wherein the plurality of reflectors are arranged at regular intervals along a longitudinal direction of the transmission line, and a spacing between at least one pair of neighboring reflectors among the plurality of reflectors is modified.

10. The resonator of claim 9, wherein a varactor is inserted in the spacing between the at least one pair of neighboring reflectors, thus tuning a resonant frequency.

11. A bandpass filter formed by connecting a plurality of resonator units in series, each resonator unit comprising:

a transmission line through which a signal flows;

a plurality of ground plates formed on both sides of the transmission line;

a plurality of reflectors whose portions face the plurality of ground plates to form capacitance components, and formed at regular intervals along a longitudinal direction of the transmission line; and a resonating part resonating the signal flowing through the transmission line, and formed by adjusting at least one interval among the regular intervals between the plurality of reflectors.

12. The bandpass filter of claim 11, wherein each reflector comprises:

a plate separated from the transmission line, portions of the plate facing the ground plates; and an interconnecting via connecting the plate to the transmission line.

* * * * *